United States Patent [19]

Braunhut

[11] 4,135,719

[45] Jan. 23, 1979

[54] SPRING WHIP

[76] Inventor: Harold N. Braunhut, 200 5th Ave., New York, N.Y. 10010

[21] Appl. No.: 817,173

[22] Filed: Jul. 20, 1977

[51] Int. Cl.[2] ..... F41B 15/00

[52] U.S. Cl. ..... 273/84 R; 231/2 R

[58] Field of Search ..... 273/68–70, 273/72 R, 72 A, 80 D, 80.1, 81 A, 81.2, 84 R, 170; 135/15 PQ, 69, 75–77; 15/144 B; 231/2 R

[56] References Cited

U.S. PATENT DOCUMENTS

| | | | |
|---|---|---|---|
| 1,611,858 | 12/1926 | Middlekauff | 273/72 R |
| 1,909,932 | 5/1933 | Digel | 273/84 R |
| 2,245,655 | 6/1941 | Dukes | 273/70 |
| 2,592,013 | 4/1952 | Curley | 273/170 |
| 2,625,946 | 1/1953 | Kaston et al. | 135/75 X |
| 3,204,961 | 9/1965 | Salamone | 273/70 |
| 3,342,489 | 9/1967 | Waldo | 273/81 A X |
| 3,528,660 | 9/1970 | Kategian | 273/80 D |
| 3,554,546 | 1/1971 | Brauhut | 273/84 R |
| 3,866,619 | 2/1975 | Frisk | 135/15 PQ |
| 4,037,839 | 7/1977 | Nelson | 273/84 R |

FOREIGN PATENT DOCUMENTS

| | | | |
|---|---|---|---|
| 543517 | 7/1957 | Canada | 273/84 R |
| 356481 | 7/1922 | Fed. Rep. of Germany | 273/84 R |
| 545295 | 2/1932 | Fed. Rep. of Germany | 273/80 D |

*Primary Examiner*—Richard J. Apley

*Attorney, Agent, or Firm*—Friedman, Goodman & Teitelbaum

[57] ABSTRACT

A spring whip is formed of plural lengths of helically wound springs having respectively smaller diameters permitting them to be interconnected about a common axis. The springs are movable between a telescoped storage position, and an extended operative position. A hollow housing is provided both as a hand grip as well as a storage housing for the springs in a telescoped position. A magnet is located in the top of the housing and restrains the springs in their telescoped storage position. A weighted tip is formed at the distal end of the smallest diameter spring for aiding in the projection of the springs into their extended position, and simultaneously forming a closure for the housing when the springs are in their storage position.

7 Claims, 5 Drawing Figures

SPRING WHIP

BACKGROUND OF THE INVENTION

The present invention relates to defensive weapons and more particularly to a spring whip which can be conveniently carried by a user and can be easily placed in its whipping position.

With the increased amount of crime, and especially attacks on individuals, there is a great need for defensive weapons which can be used to inflict a limited amount of pain so as to act as a deterrent. The weapon should be of a type which can be conveniently carried by an individual, and at the same time be available for immediate operation should an emergency situation arise. Numerous such defensive weapons are currently available. However, most of them require a great amount of time to place into operation. Such time delay can frequently result in harm to the individual before he has an opportunity to even assemble the defensive weapon. Other prior art devices are extremely dangerous and provide hazards to the individual carrying them and are therefore generally avoided. Still other devices are only available for summoning aid by sounding alarms, but do not provide an immediate weapon which can inflict pain and ward off an attacker.

A useful self-defense weapon has been described in my U.S. Pat. No. 3,554,546. In that patent there is described a spring whip which can be utilized as a defensive weapon, and which is formed of interconnected lengths of springs, wherein the selected diameter of the springs provide a compact, telescoped arrangement which attributes to the convenience of carrying the device. The conventional spring construction which consists of a succession of helical turns permits interconnecting of the spring lengths in their extended operative position by merely providing variations in the diameters of cooperating helical turns which produce a wedging engagement between adjacent spring lengths. The lengths of springs are stored in a housing which also serves as a hand grip. In order to facilitate the movement of the springs from their storage to their projected position extending from the housing, a number of weights are movably disposed within the hollow interior of one of the springs and are confined within that spring by bending respective opposite ends of the spring. As the spring whip is projected from the housing, the plural weights move within that spring and roll toward the remote end of the spring to aid in the projection of the springs into their extended position.

While such spring whips have been found quite useful, numerous problems have presented themselves with such devices to detract from their most efficient operation. For example, the lengths of spring did not have an arrangement for restraining their movement within the housing, and accordingly there was a tendency for the springs to loosen from the housing and accidentally move into their extended position. Furthermore, the movement of the weights provided an awkward arrangement in the projection of the lengths of springs, since they had a tendency to roll and move within the spring and continuously provided a source of annoying noise and disturbance. Furthermore, because the ends of the smallest spring were bent to retain the plural weights, the remote end of the housing had a sharp pointed edge, which had a tendency to cut and harm the individual carrying the weapon even when the weapon was not being used.

These and other various problems provided an inconvenience and shortcoming to the spring whip described in the aforementioned patent.

SUMMARY OF THE INVENTION

Accordingly, it is an object of the present invention to provide an improved spring whip which avoids the aforementioned problems of the prior art.

Yet another object of the present invention is to provide a spring whip which can be utilized as a defensive weapon, and which can be conveniently stored and readily put into use in an emergency situation.

It is a further object of the present invention to provide a spring which includes a hollow housing serving as a hand grip in which several spring lengths are movable from a compact, telescoped storage position into an interconnected, elongated whipping position, and which includes means for restraining the springs in their telescoped storage position.

A further object of the present invention is to provide a spring whip including several spring lengths retained in a hollow housing which includes a weighted tip at the distal end of the smallest diameter spring, which tip serves as an aid in projecting the several springs into their extended position, as well as serving as a closure for the hollow housing when the springs are in their telescoped storage position.

A further object of the present invention is to provide a spring whip having plural lengths of telescoped springs stored within a housing and capable of extending into a whipping position, wherein the housing includes a cap holding a magnet which restrains the springs in their telescoped storage position.

Briefly, the invention provides a spring whip having a hollow housing serving as a hand grip and providing an internal storage compartment. Plural lengths of helically wound springs are provided. The springs are of selected diameter sizes which are operatively arranged relevant to each other on a common axis so as to be movable between a telescoped storage position within the storage compartment and a whipping position extending from one end of the storage compartment. The selected diameters of the springs are effective to cause interconnection of the telescoped ends of the springs in their extended position. Retaining means are coupled to the housing for normally restraining the springs in their telescoped storage position.

In an embodiment of the invention, the retaining means includes a magnet positioned at the other end of the hollow housing. The springs are formed of magnetic attracting material with the upper ends of the springs being flat to provide uniform abutment against the magnet when the springs are in their telescoped storage position.

The invention further comprises a weighted tip coupled to the distal end of the smallest diameter spring to thereby aid in the projection of the springs into their extended position and also provide a closure for the outermost end of the housing when the springs are in their telescoped storage position.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing, like reference characters designate like parts.

DESCRIPTION OF THE PREFERRED EMBODIMENTS

Figure 1:
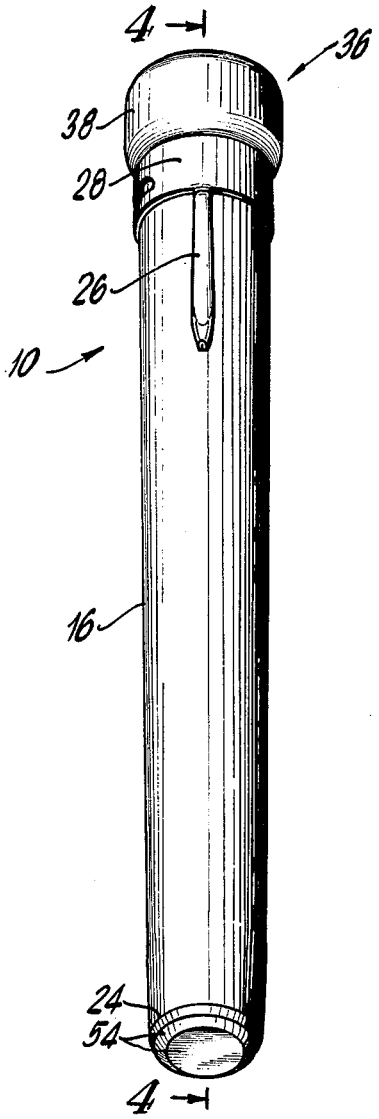
FIG. 1 is a perspective view of the defensive weapon of the present invention, with the spring lengths thereof being in their storage position within the hand grip.
Figure 4:
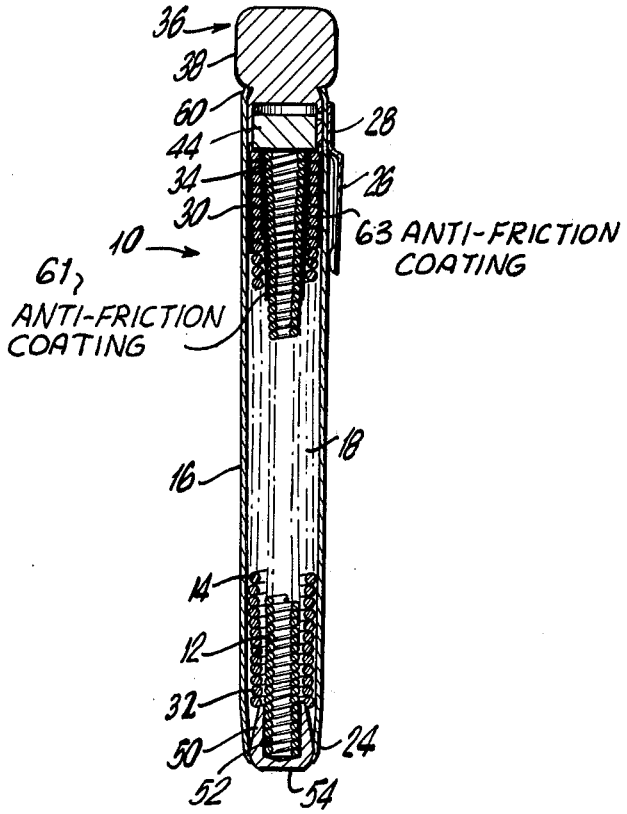
FIG. 4 is a side sectional view taken along the 4—4 of FIG. 1 and showing the spring whip with the spring lengths thereof in their storage position within the hand grip.
Figure 5:
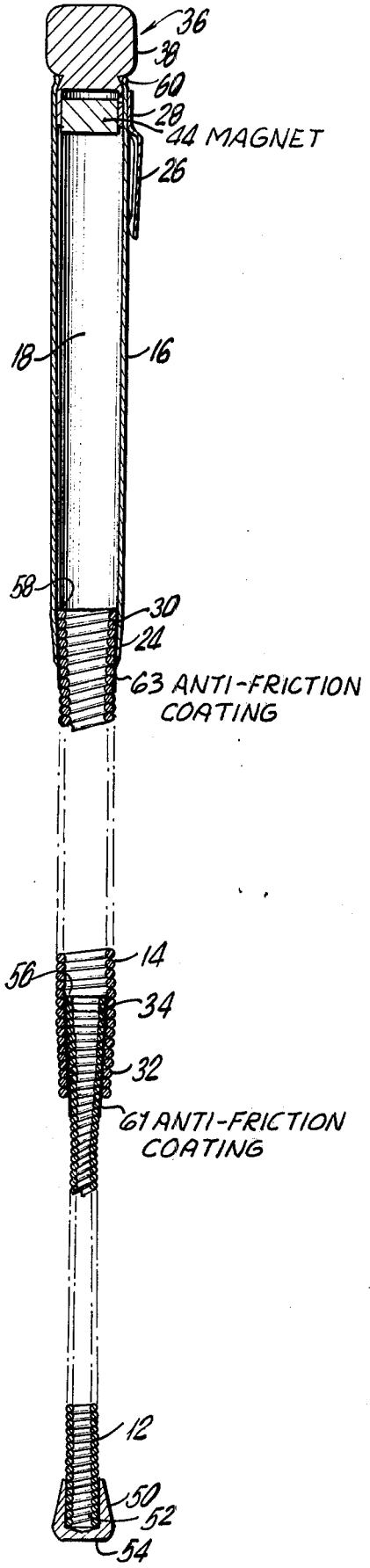
FIG. 5 is a sectional side view illustrating the spring lengths in their extended position from the hand grip.

In the figures, there is shown a defensive weapon, specifically a spring whip generally designated at 10 which is constructed essentially of plural lengths of springs. In the embodiment shown, there are provided two springs 12, 14 which are interconnected to form an elongated configuration which can be used effectively as a whip. The springs can be stored in a compact, telescoped position, as is shown in FIGS. 1 and 4, so that it can be conveniently stored in a small space, such as a purse or pocket. At the same time, it can be conveniently put into use as a whip by extending the springs into their whipping position, as shown in FIG. 5.

The spring whip 10 includes a hollow elongated housing 16, shown as a cylindrical member. The housing defines an internal cylindrical shaped storage compartment 18, and includes an upper entrance opening 20 and a lower smaller exit opening 22. The lower opening includes a conical lip 24 which provides a lower housing exit opening of a progressively diminished extent, for a purpose which will hereinafter be described. The housing 16 conveniently includes a pocket clip 26, formed with a retaining ring 28, which provides for convenience of carrying the weapon in a pocket.

The helical springs 12, 14 are conventionally wound. However, the larger spring 14 has its upper tapered end 30 wider and its tapered lower end 32 narrower than its central body portion. The achieve this, by way of example, the top few turns of the spring can be tapered with progressively increasing diameters while at its lower end 32, the last few helical turns are tapered with progressively diminishing diameters.

Spring 12, like spring 14, is also a conventionally helically wound spring. However, its upper end 34 is tapered to be wider than the rest of its body, which is of substantially uniform diameter. To achieve this, the top few helical turns can be tapered with progressively increasing diameters. By so shaping the springs, the springs will form interconnections permitting telescoping of the springs and causing a wedging engagement between the springs in their extended position. Specifically, with regard to spring 14, the lower narrower diameter portion 32 is permitted to pass through the opening 22 of the conical lip 24 of the housing 16, while its upper wider portion 30 is prevented from passing through the opening 22 of the conical lip, as clearly shown in FIG. 5. In a similar manner, the wider end 34 of the spring 12 is held by the narrower end 32 of the spring 14. However, the rest of the spring 12 is able to pass through the narrower end 32 of the spring 14.

In this way, the springs can be telescopically positioned one within the other so that both springs have a common axis, and thus the springs can be retained in a stored position within the housing compartment 18 as shown in FIG. 4. At the same time, they can be projected into their extended whipping position whereby the ends of adjacent springs will form a wedging engagement with each other to hold the springs in their extended positions. While only two such springs are shown, additional springs could be included, wherein each of the additional springs would be of progressively smaller diameter with respect to the spring immediately above or around it, and with each of the springs being similar to spring 14, so that its respective upper end is wider and its lower end narrower. Only the lowermost, smallest diameter spring would have a wider upper end with a substantially uniform main body portion.

Figure 3:
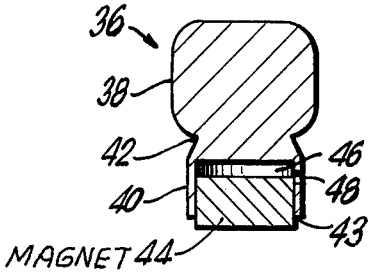
FIG. 3 is a sectional elevational view of the cap and magnet provided in the top of the housing of the present invention.

In order to retain the springs in their telescoped storage position within the housing, there is provided a magnet at the upper end 20 of the housing, where the springs are fabricated from a magnetic attracting material. The magnet is held within a cap 36 including a head portion 38 with a tubular body portion 40 interconnected to the head portion by means of a narrowing neck portion 42. The cap 36 can be made of an integral construction with a bore 43 formed within the body portion and available to accommodate the magnet 44, as best shown in FIG. 3.

In assembling, the magnet 44 is made to have a tight fit within the bore 43 whereby it will be held therein by a press fit. Because of the tightness of the fitting, an air space 46 is provided between the magnet and the head portion 38, and an air hole 48 is radially provided in the body portion 40 and in communication with the air space 46 to permit escape of the air as the magnet 44 is pressed within the bore 43. Preferably, a conventional adhesive is also used to ensure the fixed connection between the magnet and the cap.

A tip 50 is provided at the distal end 52 of the smallest diameter spring 12. The tip 50 is shown in frustoconical configuration with its base being of substantially circular configuration and being of a size substantially equal to the lower opening 22 of the housing 16. A seat is formed into the tip 50 of a size to accommodate the distal end 52 of the spring 12 which is inserted in the tip seat. The tip 50 serves as a weighted end to the lengths of springs to aid in the projection of the springs into their extended whipping position. At the same time, it also serves as a closure for the lower opening of the housing 16 to thereby provide a smooth finished end to the housing and prevent any hazards to the carrier of the weapon when in the stored condition.

In order to facilitate retaining the springs in their telescoped storage position within the housing 16, the upper ends of the springs are ground flat at 56 and 58 to provide an abutting surface against the magnet 44. The length of the smallest spring 12 will be such that with its tip 50 assembled thereto, its composite length will be equal to the distance from the lower end of the magnet 44 to the lower edge of the housing 16, as can best be seen in FIG. 4. In this manner, the bottom surface 54 of the tip will serve to close the exit 22 of the housing, and at the same time, the flattened end of the spring will be abutting the magnet.

Figure 2:
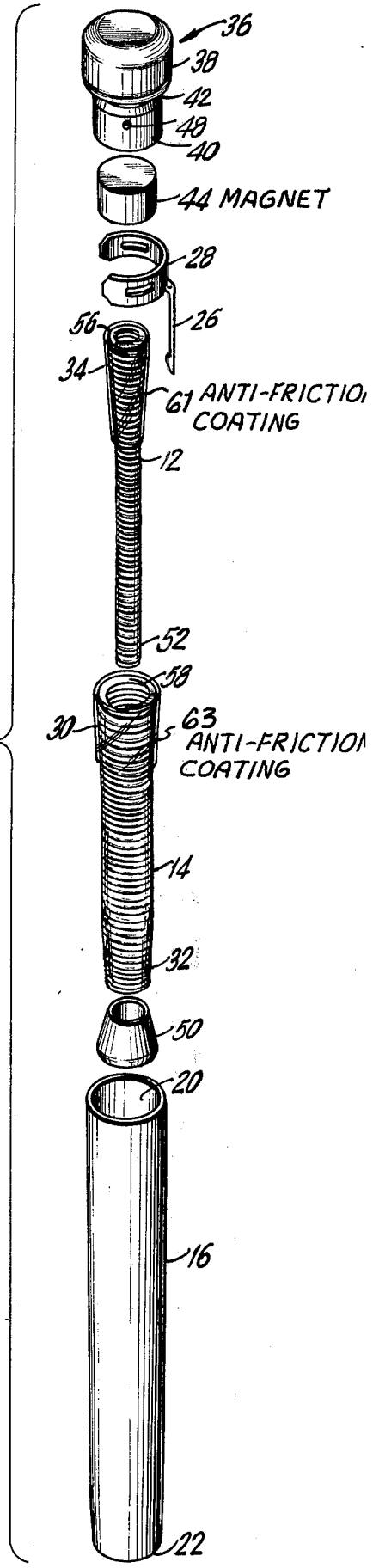
FIG. 2 is an exploded view of the various parts forming the spring whip in accordance with the present invention.

In assembling the spring whip, as can best be seen in FIG. 2, the springs are placed one inside the other in telescopic arrangement. The tip 50 is then press fit onto the end of the smallest diameter spring. Preferably, a conventional adhesive can be applied to ensure the retention of the tip on the distal end of the spring. The telescoped springs are then inserted into the wider end 20 of the housing 16 and will be retained therein by means of the lower conical lip 24 on the housing. The magnet is then press fit within the cap, and the body portion of the cap is then inserted into the upper end of the housing. The cap is press fit within the housing, and then the upper end of the housing can be crimped at 60, against the neck portion of the cap as can best be seen in FIGS. 4 and 5, to retain the cap within the housing.

In order to prevent the possibility of locking between the interconnected ends of the springs during their extended position, and in order to facilitate disengagement or unlocking of the ends in order to store the springs in their telescoped storage position, Teflon or other similar substance is placed at the interconnected ends or edges to provide anti-friction coatings 61 and 63. Thus, although the edges will be wedges together to hold them in their extended position, they can be easily disengaged and telescoped to the stored condition.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A spring whip comprising a hollow housing serving as a hand grip and providing an internal storage compartment, plural lengths of helically wound springs, said springs being of selected diameter sizes ranging from a small diameter spring to a large diameter spring, said springs being operatively arranged relative to each other about a common axis so as to be movable between a telescoped storage position within said storage compartment and an extended whipping position extending from a first end of said hollow housing, said springs including engaging means for interconnection of telescoped ends of said springs in said extended whipping position, retaining means coupled to said hollow housing for normally retaining said springs in said telescoped storage position, said retaining means including a magnet positioned at an opposite second end of said hollow housing, said springs being fabricated from a magnetic attracting material, cap means for closing said second end of said hollow housing, said cap means including a head portion and a tubular body portion connected thereto, said head portion having a larger cross-section facing in a longitudinal direction of said hollow housing than said tubular body portion, said magnet being retained within said tubular body portion, said tubular body portion extending into said second end of said hollow housing, said cap means further including a conical neck portion interconnecting said head and tubular body portions, said neck portion having a smaller cross-section facing in said longitudinal direction than said tubular body portion to provide a recess, an edge of said second end of said hollow housing being crimped into said recess against said neck portion to retain said tubular body portion within said hollow housing, a weighted tip being coupled to a distal end of said small diameter spring to aid in projecting said springs into said extended whipping position where said weighted tip overcomes attraction of said magnet, and each of said springs having an end surface facing said magnet for contact therewith, each said spring end surface being flat to provide uniform abutment against said magnet for sufficient attraction therebetween when said springs are in said telescoped storage position.

2. A spring whip as in claim 1, wherein an outermost end of said tip is of a size substantially equal to an opening in said first end of said hollow housing to close said opening when said springs are in said telescoped storage position, and a circular seat provided in said tip at an opposite end thereof for receiving and retaining said distal end of said small diameter spring.

3. A spring whip as in claim 1, wherein said engaging means include said telescoped ends of adjacent telescoped pairs of springs being of cooperating progressively diminishing diameters for wedging engagement therebetween at termination of movement of said springs into said extended whipping position.

4. A spring whip as in claim 3, wherein said telescoped ends are coated with a Teflon material to allow unlocking therebetween.

5. A spring whip as in claim 1, wherein said hollow housing is provided with a conical lip defining an exit opening of a progressively diminishing extent, said large diameter spring including an end of progressively increasing diameter, said end of said large diameter spring and said conical lip cooperating together to provide a wedging engagement therebetween at termination of movement of said springs into said extended whipping position.

6. A spring whip as in claim 5, wherein said end of said large diameter spring is coated with a Teflon material to allow unlocking thereof.

7. A spring whip comprising a hollow housing serving as a hand grip and providing an internal storage compartment, plural lengths of helically wound springs, said springs being of selected diameter sizes ranging from a small diameter spring to a large diameter spring, said springs being operatively arranged relative to each other about a common axis so as to be movable between a telescoped storage position within said storage compartment and an extended whipping position extending from a first end of said hollow housing, said springs including engaging means for interconnection of telescoped ends of said springs in said extended whipping position, retaining means coupled to said hollow housing for normally retaining said springs in said telescoped storage position, said retaining means including a magnet positioned at an opposite second end of said hollow housing, said springs being fabricated from a magnetic attracting material, cap means for closing said second end of said hollow housing, said cap means including a head portion and a tubular body portion connected thereto, said magnet being retained within said tubular body portion, said tubular body portion extending into said second end of said hollow housing, said magnet being fit tightly within said tubular body portion, an air space being provided between said magnet and said head portion, and a radial air hole being provided in said tubular body portion and communicating with said air space to permit said magnet to be positioned into said tubular body portion.

* * * * *